United States Patent [19]

Kojima et al.

[11] Patent Number: 4,666,816

[45] Date of Patent: May 19, 1987

[54] METHOD OF MANUFACTURING AN AMORPHOUS SI ELECTROPHOTOGRAPHIC PHOTORECEPTOR

[75] Inventors: Yoshimi Kojima, Nara; Shiro Narikawa, Kashihara; Takashi Hayakawa, Tenri; Hideo Nojima; Eiji Imada, both of Nara; Toshiro Matsuyama, Tenri; Shaw Ehara, Nara, all of Japan

[73] Assignee: Sharp Kabushiki Kaisha, Osaka, Japan

[21] Appl. No.: 902,042

[22] Filed: Aug. 26, 1986

Related U.S. Application Data

[63] Continuation of Ser. No. 688,660, Jan. 3, 1985, abandoned.

[30] Foreign Application Priority Data

Jan. 10, 1984 [JP] Japan ..... 59-3798

[51] Int. Cl.[4] ..... G03G 5/082

[52] U.S. Cl. ..... 430/128; 430/95; 427/39

[58] Field of Search ..... 430/95, 128; 427/39

[56] References Cited

U.S. PATENT DOCUMENTS 4,460,670 7/1984 Ogawa et al. ..... 430/95 X
4,532,196 7/1985 Yasui et al. ..... 427/39 X

*Primary Examiner*—Roland E. Martin
*Attorney, Agent, or Firm*—Birch, Stewart, Kolasch & Birch

[57] ABSTRACT

A method of manufacturing an electrophotographic photoreceptor having an amorphous silicon layer formed as a photoconductive layer, on an electrically conductive support member. The manufacturing method includes the steps of preparing the amorphous silicon layer as the photoconductive layer by employing $Si_2H_6$ (disilane) as a main raw material gas through a glow discharge process, and simultaneously, adding nitrogen and boron to the main raw material gas, with the unsaturated bond being stabilized by hydrogen or hydrogen and fluorine.

6 Claims, 4 Drawing Figures

METHOD OF MANUFACTURING AN AMORPHOUS SI ELECTROPHOTOGRAPHIC PHOTORECEPTOR

This application is a continuation of application Ser. No. 688,660 filed on Jan. 3, 1985, now abandoned.

BACKGROUND OF THE INVENTION

The present invention generally relates to a photosensitive material which employs amorphous silicon and more particularly, to a method of manufacturing an electrophotographic photoreceptor which utilizes amorphous silicon mainly prepared by glow discharge of disilane and containing nitrogen and boron.

Generally, for materials of electrophotographic photoreceptors, there have been widely employed cadmium sulfide (CdS), amorphous selenium (a-Se) and amorphous arsenic selenide ($As_2Se_3$), etc. However, CdS used as a resin dispersal compound lacks in mechanical strength and durability, while a-Se, which has a wide band gap, is not provided with a sufficiently long wavelength sensitivity, and moreover, is too thermally unstable to be crystallized at high temperatures, thus not properly functioning as a photoreceptor. Meanwhile, $As_2Se_3$ is unfavorable as a material for a photoreceptor, since it is thermally unstable and contains As which is very harmful to human bodies. Furthermore, Cd and Se are also substances detrimental to human bodies, and are not preferable as a material for the photoreceptor.

Under such circumstances, attention has recently been directed to amorphous silicon (a-Si) with respect to electrophotographic photoreceptors as referred to above. Particularly, hydrogenated amorphous silicon (a-Si:H), in which a dangling bond is terminated by hydrogen, has a superior electrical characteristic, such as, the possibility of valence control owing to a small gap state density, and due to the fact that its band gap is 1.6 eV, a sufficient sensitivity is available up to the long wavelength region in the order of seven hundred and several tens nm, with superior light sensitivity over an entire visible region. Moreover, since its mechanical strength is high at 1,500 to 2,000 kg/mm$^2$ in Vickers hardness, ample durability may be expected. Furthermore, since the element Si is harmless to human bodies, it is free from any environmental pollution as one of its features. However although a-Si:H has superior characteristics which are not present in the conventional substances, if applied to the electrophotographic photoreceptor, the resistivity $\rho$ of its own at $10^9$ $\Omega$cm is so insufficient for a photoreceptor at a point of charge acceptance that a-Si:H can not be used as an electrophotographic photoreceptor independently, requiring various contrivances for the application to the photoreceptors. For example, a-Si:H has been used for a photoreceptor by addition thereto of nitrogen and boron to attain the high resistivity ($\rho > 10^{13}$).

Generally, the glow discharge of $SiH_4$ gas is used to prepare these materials, and in the case where an electrophotographic photoreceptor having desired characteristics on a predetermined electrically conductive substrate is to be formed, it is very difficult to increase the deposition rate while attempting to achieve uniform film thickness, uniform electrical, optical and photoconductive properties and also uniform quality over an entire area, especially when the photoreceptor is formed on a larger area. For example, it is true that the deposition rate is increased if a flow rate of $SiH_4$ is increased, with a simultaneous increase of RF power, but non-uniformity and deterioration of the above characteristics will undesirably occur. Accordingly, under the present state, 8 to 10 hours are required to obtain a film thickness necessary for a photoreceptor when $SiH_4$ is employed, and it has been desired to increase the deposition rate from the aspects of productivity and mass-production. It is to be noted here that a mere a-Si:H film prepared from $SiH_4$ and $Si_2H_6$ has a greater possibility of the occurrence of cracking, separation, etc. due to a large structural stress during deposition when the film thickness is increased to such an extent as required for the photoreceptor, thus not being suitable for actual applications.

Normally, in the case where a-Si:H is used for a photoreceptor, $B_2H_6$ is added to achieve High resistivity to obtain a sufficient charge acceptance as the photoreceptor, but, the resistivity $\rho$ in the order of 10—$\Omega$cm or thereabout can not be attained, and thus, a sufficient charge acceptance is not achieved.

SUMMARY OF THE INVENTION

Accordingly, an essential object of the present invention is to provide a method of manufacturing photoreceptors for electrophotography, which is capable of producing a uniform photoreceptor superior in electrical, optical and photoconductive properties over a larger area, with extremely superior productivity and applicability to mass-production, and in which for the production of an amorphous nitride film to which boron has been added (a-SiN:B:H), $Si_2H_6$ gas is employed as a main raw material so as to manufacture the electrophotographic photoreceptor through a glow discharge decomposition process.

Another important object of the present invention is to provide a manufacturing method as described above, which is simple in steps, and can be readily introduced into production lines at low cost.

In accomplishing these and other objects, according to one preferred embodiment of the present invention, there is provided a method of manufacturing an electrophotographic photoreceptor including an amorphous silicon layer formed as a photoconductive layer on an electrically conductive substrate. The manufacturing method comprises the steps of preparing the amorphous silicon layer as the photoconductive layer by employing $Si_2H_6$ (disilane) as a main raw material gas through a glow discharge process, and simultaneously, adding nitrogen and boron to amorphous silicon, with the dangling bond being terminated by hydrogen or hydrogen and fluorine.

According to the present invention as described above, an improved method of manufacturing electrophotographic photoreceptors has been advantageously developed.

BRIEF DESCRIPTION OF THE DRAWINGS

These and other objects and features of the present invention will become apparent from the following description with reference to the accompanying drawings, in which.

DETAILED DESCRIPTION OF THE INVENTION

The following description and, Examples are presented for the purpose of illustrating the present invention, without any intention of limiting the scope thereof.

Examples in which $Si_2H_6$ (disilane) is used as a main raw material gas, with the employment of $NH_3$ (ammonia) and $B_2H_6$ (diborane) as additive gases, will be described. As the gases to be added, there may be employed, besides the above, various other nitrides and borides, for example, $N_2$, $BCl_3$ and $BF_3$, and high hydrogenated boron to obtain the same effects.

Generally, the a-Si:H film tends to show different properties according to various chambers, even when produced under the same preparation conditions, and therefore, the process for manufacturing a specific electrophotographic photoreceptor will be explained here according to the order of the steps.

Accordingly, if prepared by the steps to be explained hereinbelow, similar electrophotographic photoreceptors may be obtained by different manufacturing apparatus.

In the first instance the method of determining compositions and prepartion conditions will be described.

With employment of a capacitively coupled GD-CVD as the preparing apparatus, a substrate (C#7059) of 1 mm in thickness and 4 $cm^2$ in area having to surfaces washed is fixed on a substrate holder in a vacuum chamber of the apparatus, and the vacuum chamber is evacuated up to $1\times10^{-6}$ torr, with the substrate being heated at a temperature of 250° C. by a heater during the time. Subsequently, 90 sccm of the main raw material gas $Si_2H_6$ and 3 sccm of the additive gas $NH_3$ are respectively introduced into the vacuum chamber, and glow discharge plasma is generated under the conditions of gas pressure at 1 torr, RF frequency at 13.56 MHz and output at 300 W, thereby produces a film of about 2 $\mu$m in approximately 10 minutes. With respect to a-SiN:H on the substrate, dark resistivity $\rho d$, and resistivity under illumination at 0.3 mW of He-Ne laser ($\lambda$=6328 Å)$\rho p$, are respectively measured. In order to investigate the dependency of resistivity on nitrogen concentration, films are prepared with respect to three levels thereof at $NH_3$=9, 27 and 81 sccm, with $Si_2H_6$ being maintained constant at 90 sccm, and the resistivity of each film is measured for resistivity values, while the range of $NH_3$ flow rates is altered depending on necessity.

Figure 1:
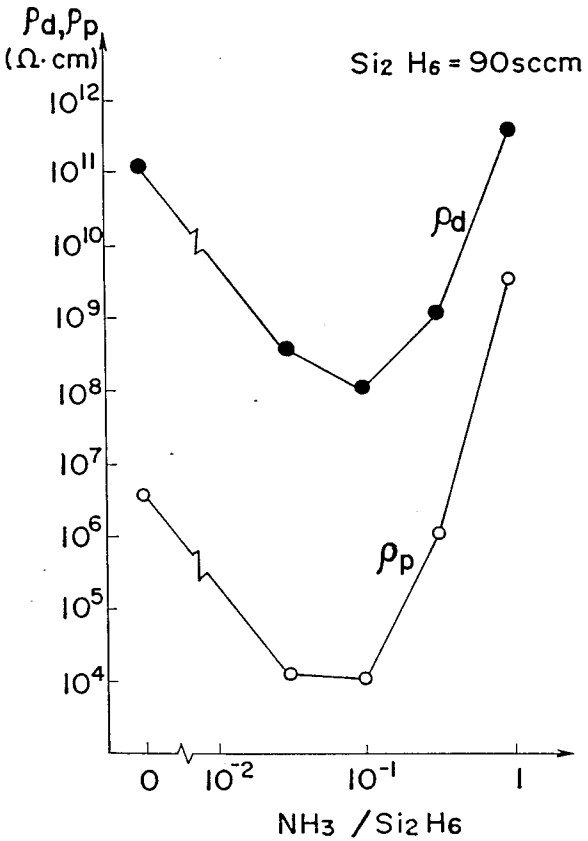
FIG. 1 is a graph for explaining dependency of dark resistivity ($\rho$d) and resistivity under illumination $\rho$p on the molar ratio $NH_3/Si_2H_6$.

In FIG. 1 showing the results of the above measurements, it is seen that both the dark resistivity ($\rho d$) and the resistvity under illumination $\rho p$ assume minimum values in the course of increasing the amount of $NH_3$.

Subsequently, at the flow rates of the above minimum values ($NH_3/Si_2H_6$ is $10^{-1}$ in the present Example), $B_2H_6$ is added to study the dependency of the dark resisitivity ($\rho d$) and the resistivity under the illumination $\rho p$ on $B_2H_6$. The conditions for the preparation are such that, with the relations $Si_2H_6$=90 sccm, and $NH_3$=9 sccm maintained constant, $H_2$ diluted $B_2H_6$ gas (0.3% $B_2H_6$ in $H_2$) is employed as boron additive gas, and the resisitivity of each film is similarly measured by altering the $B_2H_6$ flow rates to 10, 30, 90 and 270 sccm.

Figure 2:
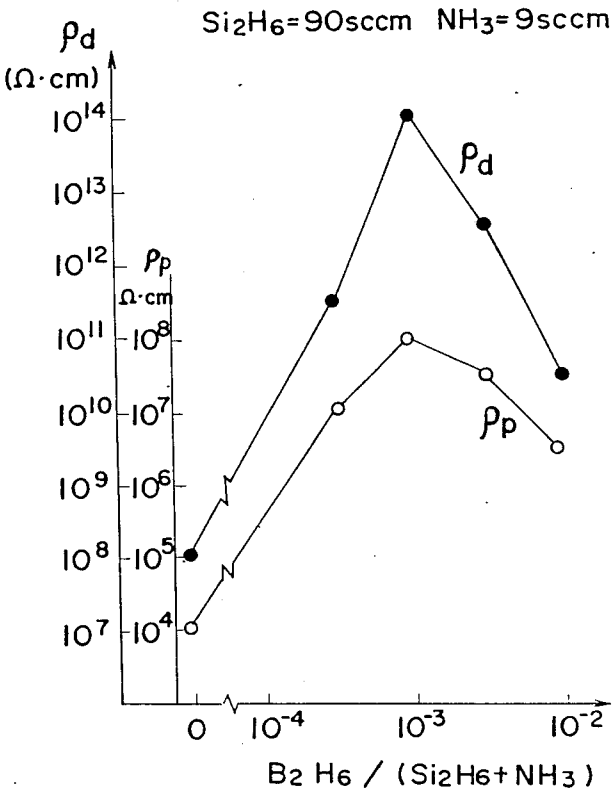
FIG. 2 is a graph for explaining dependency of $\rho$d and $\rho$p on the molar ratio $B_2H_6/(Si_2H_6+NH_3)$ (diborane)

In FIG. 2, there is shown a graph representing the results of the above measurements, in which the dark resistivity $\rho d \cong 10^{14}$ $\Omega$cm is obtained at $B_2H_6/(Si_2H_6+NH_3)=10^{-3}$, with a sufficient resistivity for an electrophotographic photoreceptor, and since resistivity under illumination $\rho p=10^8$ $\Omega$cm is obtained at the same molar ratio, variation of light resistivity is in six orders. As is seen from the above, there is present a composition (i.e., compensation region) having sufficient characteristics as an electrophotographic photoreceptor at a certain amount of boron.

In the case as described so far, although $B_2H_6$ addition amount is determined based on $NH_3/Si_2H_6$ flow rate ratio at which the dark resistivity $\rho d$ becomes the minimum, since the dependency of the dark resistivity ($\rho d$) on $NH_3/Si_2H_6$ gradually varies, specific resistivity necessary for an electrophotographic photoreceptor may be readily obtained even at flow rate ratios other than the minimum flow rate ratio.

Figure 4:
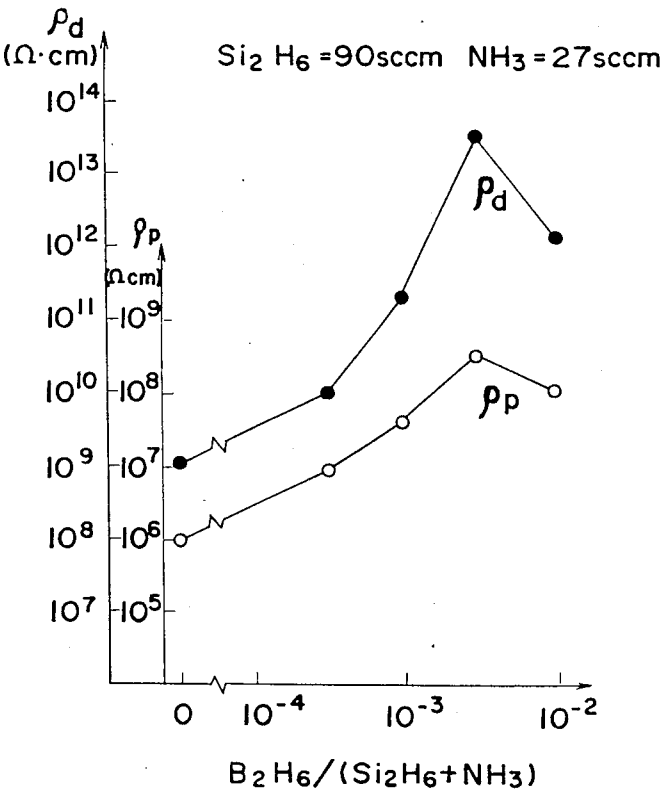
FIGS. 3 and 4 are graphs for explaining dependency of $\rho d$ and $\rho p$ on $B_2H_6/(Si_2H_6+NH_3)$ (diborane) with different $NH_3$ flow rates.
Figure 3:
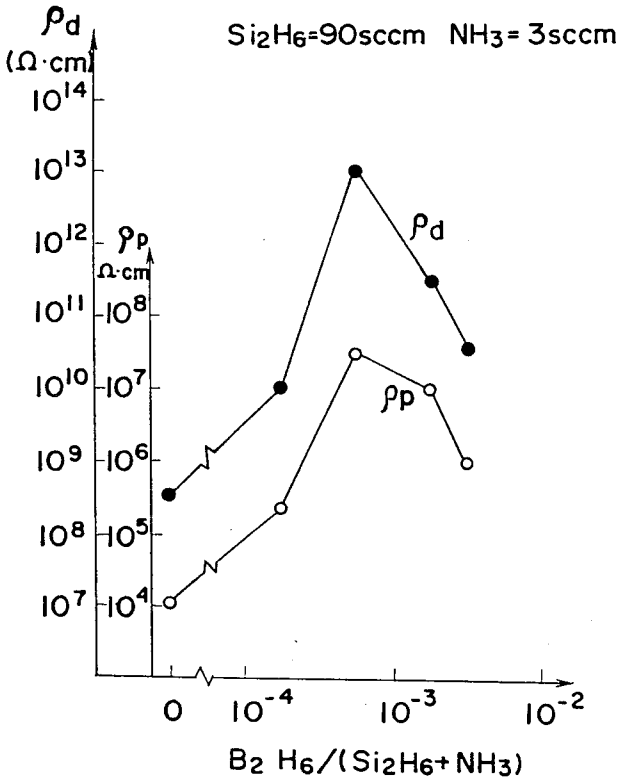

FIG. 3 shows $B_2H_6$ addition dependency in the case where $Si_2H_6$=90 sccm and $NH_3$=3 sccm, while FIG. 4 represents $B_2H_6$ addition dependency in the case where $Si_2H_6$=90 sccm and $NH_3$=27 sccm. In both cases, there exist composition ratios (i.e., compensating regions) having the specific resistivity ($\rho$ at $10^{13}$ $\Omega$cm) and light sensitivity ($\rho d/\rho p$ at $10^5$) necessary for an electrophotographic photoreceptor.

Subsequently, by employing, as a raw material gas, $Si_2H_6$ gas combined with $NH_3$ gas and $B_2H_6$ gas at the composition selected from the above compensating region, a photosensitive drum for electrophotography is produced in a manner as described hereinbelow.

With an aluminum drum, sufficiently smooth on the surface and properly cleaned, being accommodated in a vacuum chamber, while the vacuum chamber is being evacuated by a vacuum pump, the temperature of the aluminum substrate is maintained at 250° by a heater, so that the vacuum degree reaches $1\times10^{-6}$ torr. Then, the raw material gases $Si_2H_6$=90 sccm, $NH_3$=9 sccm, and $B_2H_6$ ($H_2$ diluted)=30 sccm are introduced into the vacuum chamber, and with the gas pressure being maintained constant at 1 torr, and high frequency wave at 13.56 MHz is applied at 300 W so as to generate glow discharge plasma for about 2 hours, thereby to form a-SiN:B:H film of about 25 $\mu$m in thickness on the drum.

The a-SiN:B:H photosensitive drum produced in the manner as described above was installed on a charging and exposure experimental device, and subjected to a positive charge by a corona discharge at +6.0 KV for exposure through employment of a light emitting diode with a wavelength of 635 nm and a light amount of 55 $\mu$W. As a result, extremely favorable charging and exposure properties were obtained with a charging capacity at 40 V/$\mu$m and a half-life exposure amount of about 5 erg/$cm^2$. On the other hand, the same photosensitive drum as described above was installed on a commercially available copying apparatus for the image formation, with the result that clear and definite images at high density and superior in resolving power and gradient reproduction were obtained.

Photosensitive drums having superior photosensitive properties may be produced in the compensating regions in FIGS. 3 and 4 besides the composition ratios as described above, and therefore, even if any deviation takes place from the optimum composition ratio during mass-production by certain causes, it is possible to stably produce high quality drums by only correcting the flow rate of $B_2H_6$ to a certain extent, thus providing superior productivity. Moreover, since the film forming speed is hardly altered when $NH_3$ and $B_2H_6$ are added to $Si_2H_6$, there is no possibility that the drum preparation time is prolonged through dilution of the main raw material gas by the gas added, and there may be available a film forming speed 5 to 10 times that in the case where $SiH_4$ gas is employed as the raw material, thus making it possible to effect a highly economical and stable production. Particularly, since the film forming speed is improved through employment of $Si_2H_6$ gas instead of $SiH_4$ gas, the addition efficiency of nitrogen and boron is worsened, and it becomes easier to obtain specific resistivities necessary for the photoreceptor in a region over a wide range of the raw material gas. For example, in the case of $SiH_4$ gas, there is a value where the specific resistivity becomes the minimum in the mixing ratio with respect to the nitrogen adding gas, and therefore, the boron adding gas is added in the amount necessary to compensate so as to impart a required higher resistivity to the photoreceptor. However, in the case where $Si_2H_6$ gas is employed, the film forming speed is high, with an inferior addition efficiency, and therefore, when nitrogen is to be added, variation of the specific resistivity becomes moderate in the range with the same mixing ratio as in the case of $SiH_4$, and thus, it may be regarded that the compensation region for obtaining the specific resistivity necessary for the photoreceptor is increased in effect. Accordingly, the nitrogen adding gas flow rate range for providing a higher resistivity is considered to have been widened for providing the higher resistivity, thus facilitating the control of the composition, to supply a stable material from the aspect of the productivity.

As is clear from the foregoing description, according to the present invention, it is possible to form the photoconductive layer provided with superior electrical and mechanical properties necessary for electrophotographic photoreceptors at high speeds, with a marked improvement in the production of photoreceptors.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A method of manufacturing an electrophotographic photoreceptor including an amorphous silicon layer formed as a photoconductive layer on an electrically conductive support member comprising providing $Si_2H_6$ (disilane) as a main raw material gas subjected to a glow discharge process, while simultaneously, adding nitrogen and boron to said main raw material gas, with unsaturated dangling bonds being stabilized by hydrogen, said respective gases $Si_2H_6$, $NH_3$ and $B_2H_6$ being combined at flow rate ratios for $NH_3/Si_2H_6$ of about 1/10 and $B_2H_6/(Si_2H_6+NH_3)$ of about 1/1000.

2. The method of claim 1, wherein a fluorine containing gas for further stabilizing said dangling bonds together with said hydrogen is included with said gaseous mixture.

3. A method of manufacturing an electrophotographic photoreceptor including an amorphous silicon layer formed as a photoconductive layer on an electrically conductive support member comprising providing $Si_2H_6$ (disilane) as a main raw material gas subjected to a glow discharge process, while simultaneously, adding nitrogen and boron to said main raw material gas, with unsaturated dangling bonds being stabilized by hydrogen, said respective gases $Si_2H_6$, $NH_3$ and $B_2H_6$ being combined at flow rate ratios for $NH_3/Si_2H_6$ of about 1/30 and $B_2H_6/(Si_2H_6+NH_3)$ of about 1/2000.

4. The method of claim 3, wherein a fluorine containing gas for further stabilizing said dangling bonds together with said hydrogen is included with said gaseous mixture.

5. A method of manufacturing an electrophotographic photoreceptor including an amorphous silicon layer formed as a photoconductive layer on an electrically conductive support member comprising providing $Si_2H_6$ (disilane) as a main raw material gas subjected to a glow discharge process, while simultaneously, adding nitrogen and boron to said main raw material gas, with unsaturated dangling bonds being stabilized by hydrogen, said respective gases $Si_2H_6$, $NH_3$ and $B_2H_6$ being combined at flow rate ratios for $NH_3/Si_2H_6$ of about 3/10 and $B_2H/6(Si_2H_6+NH_3)$ of about 1/33.

6. The method of claim 5, wherein a fluorine containing gas for further stabilizing said dangling bonds together with said hydrogen is included with said gaseous mixture.

* * * * *